US006748938B2

(12) United States Patent
Rice et al.

(10) Patent No.: US 6,748,938 B2
(45) Date of Patent: Jun. 15, 2004

(54) PAINTBALL GUNS

(75) Inventors: John Ronald Rice, Stoke-on-Trent (GB); Nicholas John Marks, Stoke-on-Trent (GB)

(73) Assignee: NPF Limited (GB)

( * ) Notice: Subject to any disclaimer, the term of this patent is extended or adjusted under 35 U.S.C. 154(b) by 0 days.

(21) Appl. No.: 10/325,480

(22) Filed: Dec. 20, 2002

(65) Prior Publication Data

US 2003/0154968 A1 Aug. 21, 2003

Related U.S. Application Data

(63) Continuation of application No. 09/947,673, filed on Sep. 6, 2001, now abandoned, which is a continuation of application No. 09/418,224, filed on Oct. 14, 1999, now Pat. No. 6,311,682, which is a continuation-in-part of application No. 09/272,652, filed on Mar. 18, 1999, now abandoned.

(30) Foreign Application Priority Data

Jan. 22, 1999 (GB) ..... 9901288
Jul. 16, 1999 (GB) ..... 9916688

(51) Int. Cl.[7] ..... F41B 11/00; F41B 11/32

(52) U.S. Cl. ..... 124/77; 124/56

(58) Field of Search ..... 124/77, 71, 73, 124/72, 74, 56; 42/84

(56) References Cited

U.S. PATENT DOCUMENTS 4,541,191 A * 9/1985 Morris et al. ..... 42/1.01
4,770,153 A * 9/1988 Edelman ..... 124/72
5,062,232 A * 11/1991 Eppler ..... 42/70.11
5,083,392 A * 1/1992 Bookstaber ..... 42/84
5,142,805 A * 9/1992 Horne et al. ..... 42/1.02
5,280,778 A * 1/1994 Kotsiopoulos ..... 124/73
5,303,495 A * 4/1994 Harthcock ..... 42/1.02
5,459,957 A * 10/1995 Winer ..... 42/70.11
5,704,151 A * 1/1998 West et al. ..... 42/70.07
5,704,153 A * 1/1998 Kaminski et al. ..... 42/117
5,727,538 A * 3/1998 Ellis ..... 124/32
5,736,720 A * 4/1998 Bell et al. ..... 235/1 B
5,755,056 A * 5/1998 Danner et al. ..... 42/84
5,826,360 A * 10/1998 Herold et al. ..... 42/1.02
5,881,707 A * 3/1999 Gardner, Jr. ..... 124/77
5,896,691 A * 4/1999 Kaminski et al. ..... 42/117
5,947,738 A * 9/1999 Muehle et al. ..... 124/57

(List continued on next page.)

FOREIGN PATENT DOCUMENTS

GB 2342710 A * 4/2000 ..... F41B/11/06

OTHER PUBLICATIONS

Website by Corinthian Media Services, website link: Http://www.warpig.com/com/paintball/tournament/wc97/wc97.4.ram; World and Regional Paintball Information Guide, printout dated Jun. 17, 2003.

"What an Angel" (article re Angel V6 Gear Special), PGI product catalog, Mar. 1997, pp. 74–75.*

Website link: http://archive.bibalex.org/web/1998011-3163202/http://pneuventures.com/. Website dated Jul. 3, 1998.

Pages form Oct. 1997 (No. 103) edition of *Paintball Guns International*. Title: "Warrior".

*Primary Examiner*—Charles T. Jordan
*Assistant Examiner*—John W. Zerr
(74) *Attorney, Agent, or Firm*—Foley & Lardner LLP

(57) ABSTRACT

An electronically controlled pneumatic paintball gun. The paintball gun includes an apparatus for monitoring and/or controlling one or more paramaters of the gun's operation. The gun also includes a system for providing information to a user related to the monitoring or control, including but note limited to firing mode, valve dwell time, ambient temperature, whether the gun is in live or safe mode, whether or not a fault has been detected, maximum rate of fire, battery status, and combinations thereof.

45 Claims, 2 Drawing Sheets

U.S. PATENT DOCUMENTS 5,953,844 A * 9/1999 Harling et al. ..... 42/70.06
5,967,133 A * 10/1999 Gardner, Jr. ..... 124/77
6,003,504 A * 12/1999 Rice et al. ..... 124/73
6,035,843 A * 3/2000 Smith et al. ..... 124/77
6,062,208 A * 5/2000 Seefeldt et al. ..... 124/71
6,237,271 B1 * 5/2001 Kaminski ..... 42/70.06
6,286,242 B1 * 9/2001 Klebes ..... 42/84
6,311,682 B1 * 11/2001 Rice et al. ..... 124/71
6,314,671 B1 * 11/2001 Gering ..... 42/70.11
6,321,478 B1 * 11/2001 Klebes ..... 42/70.11
6,345,461 B1 * 2/2002 Constant et al. ..... 42/70.11
6,477,801 B1 * 11/2002 O'dwyer ..... 42/70.11
2002/0170552 A1 * 11/2002 Gardner ..... 124/56
2003/0085523 A1 * 5/2003 Spaulding et al. ..... 273/317

* cited by examiner

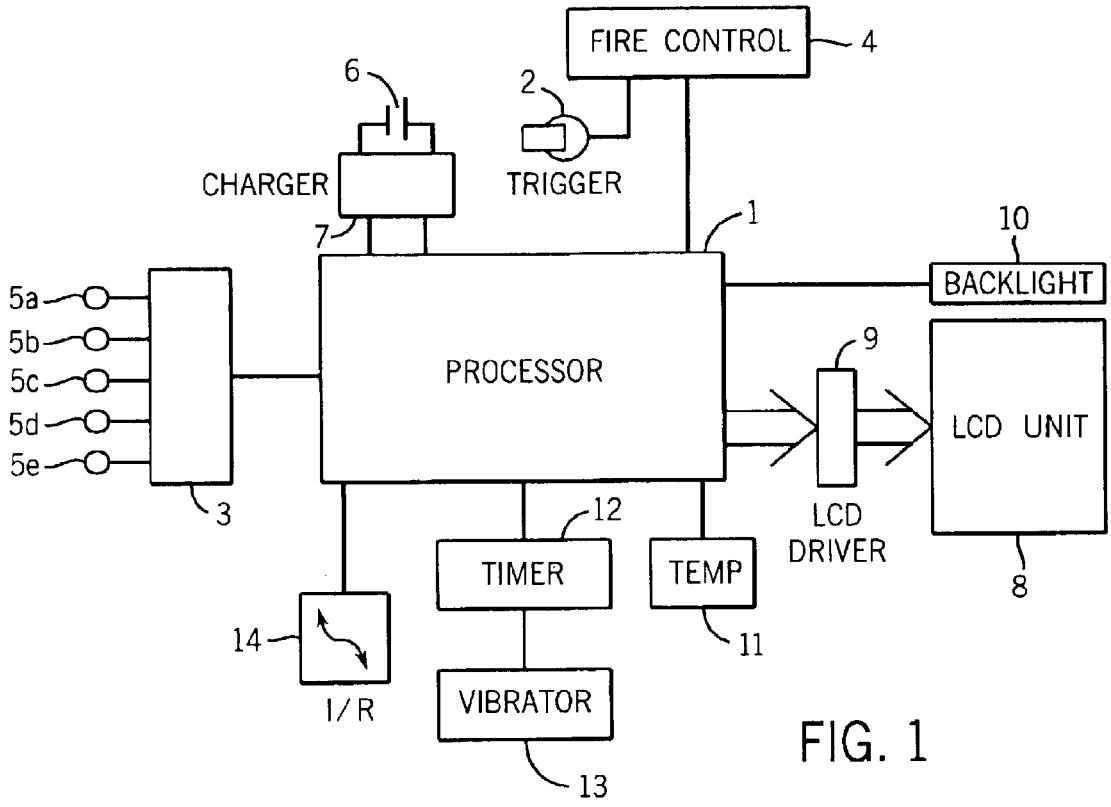
FIG. 1
FIG. 2
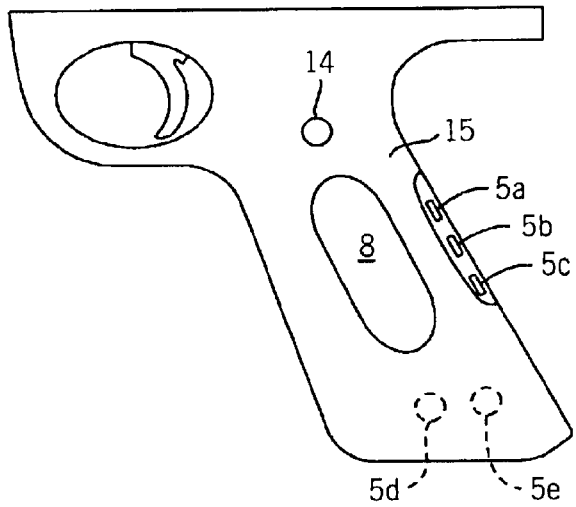

PAINTBALL GUNS

CROSS-REFERENCE TO RELATED APPLICATION(S)

This application is a continuation of application Ser. No. 09/947,673, filed Sep. 6, 2001 now abandoned, which is a continuation of application Ser. No. 09/418,224, filed Oct. 14, 1999 now U.S. Pat. No. 6,311,682, which is a continuation-in-part of application Ser. No. 09/272,652, filed Mar. 18, 1999 now abandoned. The entire contents of both applications are incorporated herein by this reference.

BACKGROUND OF THE INVENTION

This invention relates to paintball guns.

The game of paintball involves participants carrying guns which fire pellets of "paint" or dye which are fired from the gun and burst upon impact to leave a mark at the point of impact.

Most paintball guns use a pneumatic system for firing the paintballs using compressed air or other gas. More recently, such pneumatically operated guns have begun to be electronically controlled for greater effectiveness.

SUMMARY OF THE INVENTION

According to the present invention there is provided an electronically controlled pneumatic paintball gun, comprising monitoring and/or controlling apparatus for monitoring and/or controlling one or more parameters of the gun's operation and alphanumeric means for displaying data related to said monitoring or control on a display panel integral with the gun.

The display panel is most preferably mounted on the cheek of the gun.

BRIEF DESCRIPTION OF THE DRAWINGS

Embodiments of the invention will now be described, by way of example only, with reference to the accompanying drawings in which:

FIG. 1 shows schematically an electronic apparatus for use in a paintball gun;

FIG. 2 shows the handle of a gun; and

DESCRIPTION OF THE PREFERRED EMBODIMENTS OF THE INVENTION

Figure 3:
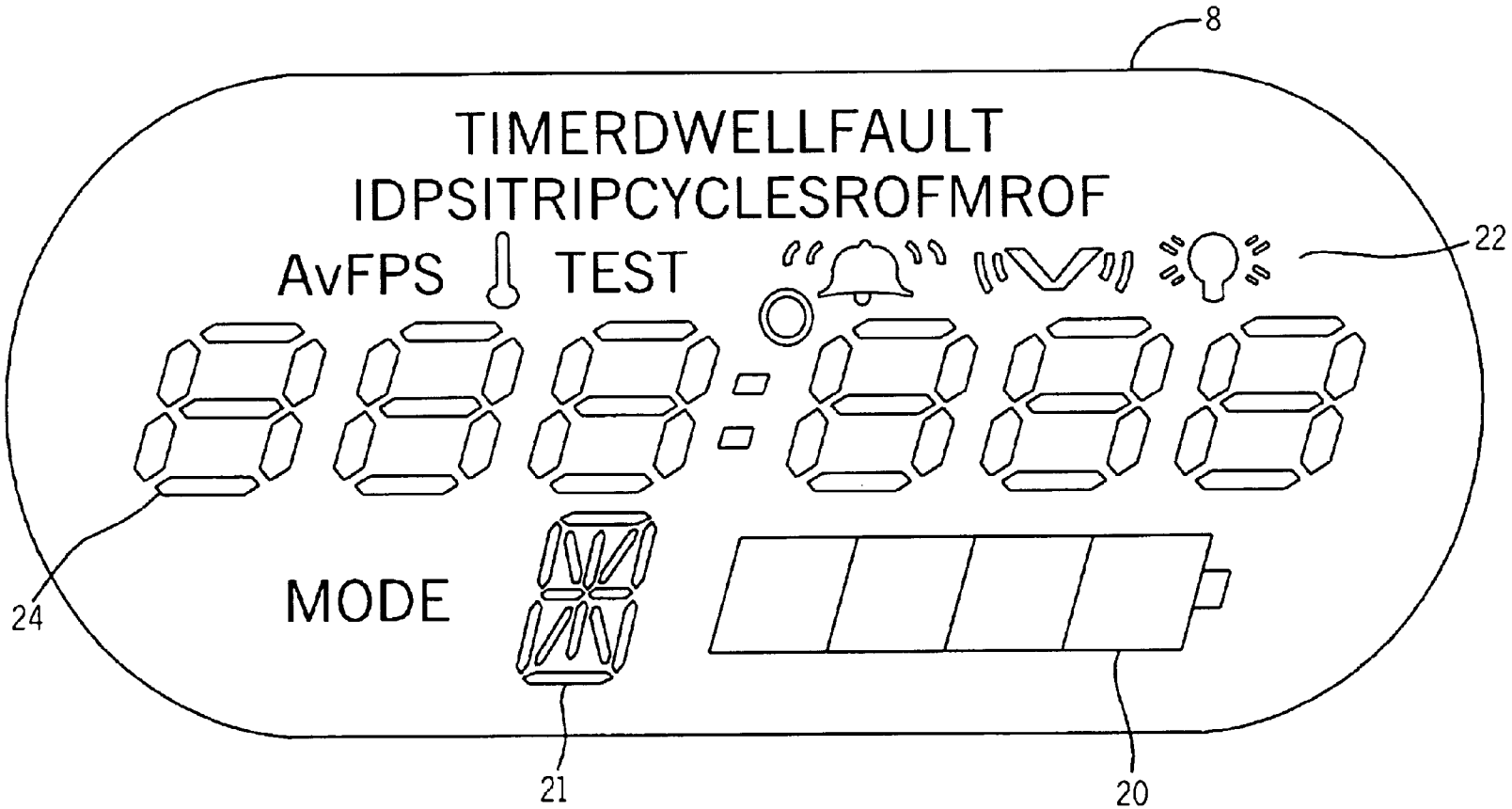
FIG. 3 shows a display.

A paintball gun embodying the present invention uses a compressed gas circuit supplied with gas from a gas cylinder to eject projectiles in the form of spheres containing paint which break upon impact. The gun is electronically controlled, typically by a microswitch operated upon by a trigger squeezed by a user's finger and the electronics control the firing mechanism and in particular ensure correct timing. The electronics also enable various different modes of firing, such as a semi-automatic mode in which each trigger actuation causes a projectile to be fired, typically up to 20 times a second, or a fully automatic mode in which a single trigger actuation causes a burst of a selectable number of shots. Other parameters such as dwell time, firing rate, number of bursts per second, and so on are also selectable under the operation of the control electronics. A paintball gun of this type is commercially available as the Angel™ gun manufactured by NPF Limited and reference is made to U.S. patent application Ser. No. 09/137,641.

FIG. 1 shows a control and display apparatus for use in a gun according to the present invention. The apparatus comprises a central processor 1 which typically includes a microprocessor. As described, operation of the gun is initiated by a user depressing a trigger 2 which acts upon a microswitch in known manner. This sends an appropriate signal to fire control/monitoring circuitry 4, which may be at least partially incorporated in the control unit 1 and which can be used to control the rate of fire, dwell time, etc, and also to fire the gun when the trigger has been operated, using the mode designated by the user. These modes may be, for example, manual, semi-automatic or automatic modes or other modes as required or as allowed by the rules of the particular event or tournament he is playing in. These operate in known manner.

A plurality of input buttons 5*a* to 5*e* are arranged to provide user input to the processor 1 via a user interface 3 and these have several different functions as will be outlined below.

The gun is powered by a battery 6 which is preferably a rechargeable type and which can charge through a battery charger 7 which has a mains input.

An integral alphanumeric display unit in the form of an LCD unit 8, driven by an LCD driver circuit 9 is connected to the processor and this displays various types of data and information. Preferably, a back-light 10 is also provided to enable better viewing of the LCD unit but which back-light may be turned off when required. The alphanumeric display need not necessarily be an LCD display.

Various other pieces of apparatus, sensors, etc, may be added to the control unit and non-limiting examples of these are shown in FIG. 1. There is shown a temperature sensor 11, a timer 12 and a vibrator 13. The timer 12 can be used for various purposes such as for timing a paintball game and for an alarm function and the vibrator 13 may be used as the alarm indicator for the timer 12. In addition, an infrared link 14 is provided which enables programming of the control unit, or by directional data exchange, to take place from a remote PC or other device fitted with a similar infrared unit. Infrared communication devices are well known. A serial link, e.g. RS232C, or other communications link may also be provided.

FIG. 2 shows the grip frame part of a paintball gun. The user holds the grip in the normal manner and squeezes the trigger 2 to fire the gun. As shown, the gun is radically different from previous paintball gun designs in that an LCD display 8 is integral with and incorporated into the gun, in this case on the cheek of the grip frame 15. It could, however, be mounted in any other position/disposition on the gun itself. The control buttons are also distributed on the grip frame. Three of the buttons 5*a*, 5*b* and 5*c* are mounted in a recessed portion where they are always accessible. The remaining buttons in this embodiment are mounted under a cheek plate (not shown) which is screwed or otherwise attached over the cheek, possibly using anti-tamper means, or tamper-indicating means such as seals, and thus are only accessible when the plate is removed. This is because these buttons are used, as described below, to alter various functions of the gun which affect its performance, rate of fire, etc. In many events, the rate of fire or other gun parameters must be set before the game begins and cannot be altered once the match is underway. By being mounted in an inaccessible position, these buttons achieve this objective.

The various functions alterable and displayable on display 8 are as follows:

Various values and words are selectably displayed by a six character alphanumeric display 24 and a plurality of fixed words/characters which are illuminated as required. A battery indicator 20 is displayed at all times and goes from blank to full (all four segments displayed). When down to about 25% power level the last segment only is displayed, and this flashes indicating low power status.

A mode indicator 21 displays the mode of firing and may show single characters or numerals such as A, B, C, 1, 2, 3 etc. Modes are displayed at all times. The mode of firing can only be changed by one of the normally inaccessible tactile switches 5*d* or 5*e*. The modes available may be, for example, SEMI: (1 shot; 1 trigger pull), BURSTS: (a 3, 4, 5, 6, 7 or 8 shot burst per trigger pull), ZIPS (3, 4, 5, 6, 7, 8 shot bursts at a rate of 8.75 shots/sec max). The MROF (Maximum Rate of Fire) function will display 8 when in the ZIP modes.

The vibrator may work in a timer mode for indicating, for example, 5 min intervals by actuating the vibrator for 3 secs. Note: if the 'V' mode is selected the 'V' is displayed on the LCD. Switching the vibratory alarm ON or OFF is selected from a sub-menu function Temperature may be displayed in ° F. or ° C. by the main alphanumeric display 24. A temperature icon is only displayed when the menu calls for it. Temp mode can be selected from the menu; Changing from Centigrade to Fahrenheit is selected from the submenu.

A trip meter is a shot counter that can be re-zeroed by the consumer. Trip can be selected from the menu. Resetting to zero is selected from the sub-menu.

A ROF (Rate of Fire) function may measure a string of shots over a selected (eg 1 second) period. The first shot starts the counter for 1 second, any shots that occur in that period are registered on the display. Then the display will not accept any input for a 3-second period. During this period the display will also flash before an additional cycle may start. The ROF mode can be selected from the menu. The data is constantly updated and so no sub-menu is required.

The display can accordingly display not only a desired rate of fire, but also the rate of fire actually achieved by the user, which can fall well short of the desired rate of fire, or could even exceed it for a very skilled marksman. Furthermore, competition rules may set an upper limit on the rate of fire, and this upper limit may be programmed in and displayed on the LCD display (MROF). More details are set out further below.

To power off the gun a tactile switch on the grip must be held for 1.5 seconds which shows the whole display for 2 seconds. Then the display shows the word "SAFE" and the back light switches OFF. The gun cannot fire in the safe mode but the battery meter is still displayed. An automatic power off function may be provided which powers off the gun if no shots are fired for a predetermined period, e.g. 60 minutes.

A unique ID number may be programmable into the gun by the manufacturers or suppliers. This number may affect, e.g. restrict, the modes it is possible for the gun to be fired in and can render the gun less likely to be stolen.

Numerous fault codes can be displayed, for example Fault 1, F1=Over temp=38° C., F2=Under temp=0° C., and so on. The fault can be selected from the menu. Should more than one fault be present the display will alternate at 2-sec cycles. The faults will only clear from the display when the fault condition is removed.

Dwell time may be displayed, e.g. in millisecs=e.g. 0:20=20 ms. Dwell is changed via a tactile button and scrolls from 12 ms to 25 ms.

MROF displays the rate of fire as shots per sec, e.g. 12=12 shots/sec. MROF may be selected from the menu but can only be changed via one of the normally inaccessible tactile buttons on the board. In one embodiment the range is 5 to 20 shots per second.

Note: If a mode of fire has a preset rate this will be displayed under the MODE function and cannot be adjusted whilst in that mode.

A cycles counter is a grand total shot counter that cannot be reset by the consumer, only by the suppliers of the gun or other authorised person.

A TRIP counter is provided, which is a shot counter that can be zeroed by the user or consumer.

A timer is a countdown timer which can, for example, count down from 60 min. At the end of the count the vibrator alarm may be activated for 10 seconds. The timer can be set in 5-min increments, i.e. OFF, 5, 10, 15 etc. A sub-menu allows changes. The settings must remain in the memory even after power has been removed.

The display may also indicate test modes and a BACK-LIGHT ON symbol 22 is included. Additional functions displayable include, inter alia, velocity, average velocity, gas pressure and gas usage, for example.

In one embodiment DWELL, MROF, MODE and TIMER functions are stored in non-volatile memory since these settings must be retained even when power is removed.

The button functions may be as follows in one embodiment.

Button 5*a*

Gun on/off when held for 1.5 seconds

Display "-live-" when on at all times unless timer started via activation to ready state via switch 4 and pulse vibrator for 3 seconds as confirmation. NOTE; menu switch 5*b* is inactive whenever the gun is in "-live-" or timer ready/timer active mode. NOTE timer can only be made active via switch 4. When in timer ready state the timer will show the set time and flash between "-live-" and set time at 1 second intervals. When gun is in the "-live-"/timer ready status, timer starts when first shot is fired then the display will show the timer counting down. The arm will go off prior to time up. This feature allows the players to know when the game end is near and that they have a final opportunity to bring the game to a conclusion. Display "-safe-" when off and switch 5*b* is now active and timer stops. Battery status to be displayed at all times; mode status to be displayed at all times even when "-safe-".

Button 5*b*

Menus active only when the gun is "-safe-". No access if the gun is "live".

FAULT—display "none" if no fault present

ID—display unique ID number

ROF—display the maximum rate of fire achieved measure between two shots

TIMER—display set time

VIBRATOR—display status

LIGHTS—display status

TEMP—display temperature

CYCLES—display total cycles

TRIP—display trip cycles

Button 5*c*

Sub menus note; no access if gun is in "-live-" status. The timer is only available in "-live-" status when switch 5*c* only puts timer in ready state, first shot will start the timer.

FAULT—"none" or "code 1"

ID—no sub mode

ROF—set to zero

TIMER—from zero to sixty in five minute increments

VIBRATOR—no sub menu

Activate for two seconds

LIGHTS—on/off

TEMPERATURE—no sub menu

CYCLES—no sub menu

TRIP—reset to zero

Button 5*d*

No access granted if gun is in "-live-" state. When switch 5*d* is pressed gun will go into "-safe-" mode (gun cannot fire), then if no further button presses occur gun will display "-safe-" after 5 seconds Menus DWELL—display dwell time MROF—display set rate of fire, NOTE; zip modes to show 9 enhanced modes to have maximum display of 13, semi mode to have maximum possible display of 20.

MODE—display status, NOTE; mode can affect the MROF

FAULT—display "none" if no fault present

ID—display unique ID number

ROF—display the maximum rate of fire achieved measure between two shots

TIMER—display set time

VIBRATOR—display status

LIGHTS—display status

TEMP—display temperature

CYCLES—display total cycles

TRIP—display trip cycles

Button 5*c*

DWELL—scroll 10 to 24 milliseconds

MROF—display set rate of fire, NOTE; zip modes to show 9 enhanced modes to have maximum possible display of 2–13, semi mode to have maximum possible display of 2–20.

MODE—A=auto, B=semi, C–I=burst modes, J–P=zip modes, R–T=ramp modes, U–Z=other modes. If no mode is allocated, then selected digit flashes and "no Acc" is displayed. Also fault code "code 1" to be displayed. NOTE; mode can affect the MROF, which must adjust accordingly, ie: last MROF setting in modes also to be retained when switching between modes. EG: semi set at 13 shots sec/mode B then mode F selected set at 12 shots/sec.

FAULT—no sub menu

ID—no sub menu

ROF—set to zero

TIMER—0–60 minutes scrolled menu in 5 minute increments

VIBRATOR—On/Off

LIGHTS—On/Off

TEMP—F/C

CYCLES—no sub menu

TRIP—reset to zero

Other Features that are Present in the Preferred Embodiment

A. FACTORY RESETS—press and hold buttons 5 and 6 together for 1.5 seconds. Display all lights up. The values may be:

TRIP—000

FAULTS—status

ID—status

ROF—0

TIMER—15 minutes

MODE—B (semi)

MROF—zips at 9 semi at 11 all enhanced at 11

DWELL—14

VIBRATOR—on

LIGHTS—off

TEMP—f

Cycles—status

B. The hopper system can be controlled via the gun to suit different parameters is hopper in semi mode switched on when a rate of 2 shots/second are achieved. In all other modes hopper to switch on after first shot.

C. Codes are used to allow access to certain parameters of the gun, which one may not wish the consumer to have access to. IE: RS232/infrared link to have a code word which will give access to setting the ID number and resetting the CYCLES. Link remains connected for this operation. Menu on the screen hyperlink. RS232/infrared link may have a further code word which will give access to override the lock out status on the internal menus ie the internal menus can be worked on for 1 hour with the gun "live" then lockout reactivates, this countdown stating when the RS232 link is removed. This is required so the guns can be set up in assembly.

D. Power saving feature, ie Electronic Sleep occurs after 10 hours.

E. Should the battery be disconnected when reconnected the gun comes on in "-safe-" mode.

F. The power source is a rechargeable battery that can be recharged without removal from the gun.

What is claimed is:

1. A pneumatic paintball gun comprising:

a gun body;

a pneumatic system within the gun body for firing one or more paintballs;

a processor in communication with the pneumatic system, the processor monitoring valve dwell time of the pneumatic system; and means for providing to a user information concerning at least one operating parameter of the pneumatic system.

2. The pneumatic paintball gun of claim 1, wherein the information is provided in the form of characters selected from the group consisting of letters, numbers, icons, symbols, and combinations thereof.

3. The pneumatic paintball gun of claim 1 further comprising a timer.

4. The pneumatic paintball gun of claim 3 wherein the timer is activated by a trigger.

5. The pneumatic paintball gun of claim 1 wherein the at least one operating parameter includes one or more parameters selected from the group consisting of: firing mode, valve dwell time, hopper control, ambient temperature, whether or not a fault has been detected, maximum rate of fire, battery status, and combinations thereof.

6. The pneumatic paintball gun of claim 5, wherein the at least one operating parameter includes valve dwell time.

7. The pneumatic paintball gun of claim 1 further comprising an electronically programmed identification mechanism.

8. The pneumatic paintball gun of claim 1 further comprising an input control for entering a control parameter.

9. The pneumatic paintball gun of claim 8 wherein the input control is mounted in a normally inaccessible position.

10. The pneumatic paintball gun of claim 8 further comprising at least one of anti-tamper means and tamper-indicating means for restraining access to the input control.

11. The pneumatic paintball gun of claim 1, further comprising a data communication link for providing programming instructions to the gun from a remote device.

12. The pneumatic paintball gun of claim 1, further comprising a data communication link providing a directional data exchange between the gun and a remote device.

13. The pneumatic paintball gun of claim 12, wherein the remote device is a personal computer.

14. A pneumatic paintball gun comprising:

a gun body;

a pneumatic system within the body for firing one or more paintballs;

means for electronically monitoring valve dwell time of the pneumatic system's operation; and a display for providing information concerning at least one operating parameter of the pneumatic system.

15. The pneumatic paintball gun of claim 14 wherein the information is displayed in the form of characters selected from the group consisting of letters, numbers, icons, symbols, and combinations thereof.

16. The pneumatic paintball gun of claim 14 wherein the at least one operating parameter includes one or more parameters selected from the group consisting of: firing mode, valve dwell time, ambient temperature, whether or not a fault has been detected, maximum rate of fire, battery status, and combinations thereof.

17. The pneumatic paintball gun of claim 16 wherein the at least one operating parameter includes valve dwell time.

18. The pneumatic paintball gun of claim 14 further comprising a timer.

19. The pneumatic paintball gun of claim 14 further comprising an input device for entering a control parameter.

20. The pneumatic paintball gun of claim 19 wherein the input device is located in a location that is normally inaccessible to a user.

21. The pneumatic paintball gun of claim 14, further comprising a data communication link for providing a directional data exchange between the gun and a remote device.

22. The pneumatic paintball gun of claim 14 wherein the display includes a backlight feature.

23. The pneumatic paintball gun of claim 14, wherein the display provides information concerning the ambient temperature.

24. The pneumatic paintball gun of claim 14, wherein the display provides information concerning the status of a battery in the gun.

25. The pneumatic paintball gun of claim 14, wherein the display provides information concerning faults in the gun.

26. The pneumatic paintball gun of claim 14, wherein the monitoring means also controls the valve dwell time of the pneumatic system's operation.

27. A pneumatic paintball gun comprising:

a body;

a pneumatic system within the body for firing one or more paintballs;

means for monitoring valve dwell time of the pneumatic system's operation; and means for informing a user of the pneumatic paintball gun about information concerning at least one operating parameter of the pneumatic system.

28. The pneumatic paintball gun of claim 27, further comprising at least one input device for entering a control parameter into the paintball gun, the at least one input device being located in a position which is normally inaccessible to a user.

29. The pneumatic paintball gun of claim 27, further comprising a data communication link for programming the gun from a remote device.

30. A pneumatic paintball gun comprising:

a trigger;

a switch actuable by the trigger;

a pneumatic system operatively connected to the switch for firing one or more paintballs;

a processor in communication with the switch for controlling and monitoring valve dwell time of the pneumatic system; and means for providing information to a user about at least one operating parameter of the pneumatic system.

31. The pneumatic paintball gun of claim 30, wherein the at least one operating parameter is selected from the group consisting of: pneumatic circuit timing, valve dwell time, rate of fire, firing mode, maximum rate of fire, and hopper control.

32. The pneumatic paintball gun of claim 30, wherein the providing means provides information concerning the ambient temperature.

33. The pneumatic paintball gun of claim 30, wherein the providing means provides information concerning the status of a battery in the gun.

34. The pneumatic paintball gun of claim 30, wherein the providing means provides information concerning how many shots have been fired from the gun.

35. The pneumatic paintball gun of claim 30, wherein the providing means provides information concerning faults in the gun.

36. The pneumatic paintball gun of claim 30, wherein the providing means provides information concerning designated time intervals.

37. The pneumatic paintball gun of claim 30, further comprising a data communication link programming the gun from a remote device.

38. The pneumatic paintball gun of claim 30, further providing an input device located in a position which is normally inaccessible to a user.

39. A pneumatic paintball gun comprising:

a body a trigger operatively connected to the body;

a switch upon which the trigger acts;

a pneumatic control system operatively connected to the switch, the pneumatic control system configured to control the firing of one or more paintballs from the paintball gun; and a processor in communication with the switch and the pneumatic system, the processor monitoring valve dwell time of the pneumatic control system.

40. The pneumatic paintball gun of claim 39, wherein the processor also controls the valve dwell time of the pneumatic control system.

41. The pneumatic paintball gun of claim 39, further comprising a data communication link for permitting the paintball gun to communicate with a remote source.

42. The pneumatic paintball gun of claim 39 further comprising an input control mounted in a location on the paintball gun which is normally inaccessible to a user.

43. The pneumatic paintball gun of claim 39, further comprising means for providing information to a user about at least one operating parameter of the pneumatic system, wherein the at least one operating parameter includes one or more parameters selected from the group consisting of: firing mode, valve dwell time, ambient temperature, whether the gun is in live or safe mode, whether or not a fault has been detected, maximum rate of fire, battery status, and combinations thereof.

44. The pneumatic paintball gun of claim 43, wherein the at least one operating parameter includes valve dwell time.

45. The pneumatic paintball gun of claim 39, further comprising a data communication link providing directional data exchange between the paintball gun and a remote device.

* * * * *

UNITED STATES PATENT AND TRADEMARK OFFICE

CERTIFICATE OF CORRECTION

PATENT NO. : 6,748,938 B2
DATED : June 15, 2004
INVENTOR(S) : John Ronald Rice and Nicholas John Marks It is certified that error appears in the above-identified patent and that said Letters Patent is hereby corrected as shown below:

Column 6,
Line 14, "is" is changed to -- i.e., --.

Signed and Sealed this

Tenth Day of May, 2005

JON W. DUDAS
*Director of the United States Patent and Trademark Office*